US005279749A

United States Patent [19]

Hanano

[11] Patent Number: 5,279,749

[45] Date of Patent: * Jan. 18, 1994

[54] METHOD FOR PERMANENT MOLD CASTING WITH PERMANENT MOLD CASTING POWDERY MOLD RELEASING AGENT

[75] Inventor: Takashi Hanano, Kobe, Japan

[73] Assignee: Hanano Commercial Co., Ltd., Hyogo, Japan

[ * ] Notice: The portion of the term of this patent subsequent to Jan. 11, 2011 has been disclaimed.

[21] Appl. No.: 915,762

[22] Filed: Jul. 21, 1992

Related U.S. Application Data

[62] Division of Ser. No. 694,609.

[30] Foreign Application Priority Data

Mar. 6, 1991 [JP] Japan ..... 3-67974

[51] Int. Cl.[5] ..... C10M 103/00; B28B 7/36

[52] U.S. Cl. ..... 252/21; 252/25; 252/18

[58] Field of Search ..... 252/12, 12.6, 18, 21, 252/25, 29; 106/38.22, 38.44

[56] References Cited

U.S. PATENT DOCUMENTS

| | | | |
|---|---|---|---|
| 3,779,918 | 12/1973 | Ikeda et al. | 252/12.6 |
| 3,856,686 | 12/1974 | Sato et al. | 252/29 |
| 3,874,862 | 4/1975 | Bickling, Jr. et al. | 252/29 |
| 3,909,424 | 9/1975 | Clark | 252/12 |
| 3,985,661 | 10/1976 | Ikeda et al. | 252/12 |
| 4,071,368 | 1/1978 | Jones | 252/30 |
| 4,148,970 | 4/1979 | McIntosh et al. | 252/25 |
| 4,202,523 | 5/1980 | Radtke | 252/25 |
| 4,310,427 | 1/1982 | Wun | 252/21 |
| 4,575,430 | 3/1986 | Periand et al. | 252/12 |
| 5,039,435 | 8/1991 | Hanano | 252/18 |

OTHER PUBLICATIONS

Metals Handbook, 9th Edition, vol. 15 Casting, ASM International, 1989 pp. 275-285.

Hawley's Condensed Chemical Dictionary, 11th Ed Van Nostrand Reinhold, N.Y. pp. 576, 794.

*Primary Examiner*—Willis, Jr. Prince

*Assistant Examiner*—J. Silvermann

*Attorney, Agent, or Firm*—Armstrong, Westerman, Hattori, McLeland & Naughton

[57] ABSTRACT

A permanent mold casting powdery mold releasing agent according to this invention consists of a granulated or powdery mixture of a lubricant, an organic polymer and a metal soap; wherein the lubricant is coated with the organic polymer or the metal soap. Therefore, the mold releasing agent allows productions of castings of high quality, in a parmanent mold casting work, with good workability and without worsening environmental situations.

6 Claims, No Drawings

METHOD FOR PERMANENT MOLD CASTING WITH PERMANENT MOLD CASTING POWDERY MOLD RELEASING AGENT

This application is a division of application Ser. No. 694,609 filed May 2, 1991, now abandoned.

BACKGROUND OF THE INVENTION

1. Industrial useful field

This invention relates to a mold releasing agent which is used by being sprayed onto inside surfaces of a molding die in a permanent mold casting work.

2. Prior Art

A permanent mold casting method is being utilized widely in manufacturing various parts for automobile and electrical equipment because cast parts of high precision can be manufactured continuously and in large quantities by this method. And, in this permanent mold casting method, a mold releasing agent is used in order to prevent a molding die from direct contact with molten metal for avoiding seizure and for improving release of products from dies.

The permanent mold casting mold releasing agent is generally classified into a mold releasing agent with an intention of heat resisting and heat insulation and a mold releasing agent with an intention of good appearances of cast surfaces, smooth flow of molten metal and stable contraction etc. The permanent mold casting mold releasing agent is coated on die surfaces after appropriate layers have been formed on the surfaces.

3. Problems to be solved by the Invention

Considerable skill has been required for coating work of a conventional permanent mold casting mold releasing agent for diecasting. Coating work carried out by a worker of poor skill would cause local slipping-off of mold releasing agent coat at an unexpected time to produce a large amount of off-spec products during operation of mass-production line. Therefore, the conventional permanent mold casting mold releasing agent has generally been coated by hand work of a skilled worker. However, productivity and quality of products have been changed every time by the difference between abilities of mold releasing agent coating workers and troubles have occurred especially in the mass-production line.

For this reason, demands have increased for a permanent mold casting mold releasing agent enabling the coating work by an automated spraying device. The coating work can be fully carried out, dispersion of coated states on every time of coating work can be avoided and quality of resulting products can always be made uniform by this mold releasing agent independently of the skill of the coating worker.

SUMMARY OF THE INVENTION

This invention has been produced on the basis of earnest studies and various systematic experiments in consideration of the foregoing points. An object of this invention is to provide a permanent mold casting mold releasing agent which can positively prevent occurrences of seizure and internal defect of products, enables good separation of products from dies, can be removed from internal surfaces of dies and external surfaces of products, can control generation of gas during casting operation, and can make the quality of resulting products always uniform independently of the skill of a coating worker by fully performing a coating work so as to avoid a dispersion of coated states on every time of the work.

This invention is, in a permanent mold casting mold releasing agent which is used by being sprayed onto inside surfaces of molding die in a permanent mold casting work; a permanent mold casting powdery mold releasing agent consisting essentially of a granulated or powdery mixture of a lubricant selected from the group consisting of boron nitride, silicon nitride, molybdenum disulfide, graphite, mica, metal oxides, sulfur compound, fluoride, talc, boron compound and phosphorus compound; an organic polymer selected from the group consisting of polyethylene, polypropylene, epoxy resin, silicon resin, phenol resin, acrylate resin and alkyd resin; and a metal soap; wherein the lubricant is coated with the organic polymer or the metal soap.

DETAILED DESCRIPTION OF THE INVENTION

The most outstanding feature of this invention is to consist of a granulated or powdery mixture of a lubricant, an organic polymer and a metal soap, and that the lubricant is coated with the organic polymer or the metal soap.

It is effective to select a content of the organic polymer and the metal soap in relation to the lubricant from a range of 0.1 through 45 weight percent. The reason is that the adhesion effect of the lubricant to metal mold insides is not enough when the content is smaller than 0.1 weight percent, and a build-up occurs to cause a difficulty in removing the mold releasing agent from the metal mold insides, i.e. a decrease in mold releasing efficiency or a worsening of dimensional accuracy of product when the content is larger than 45 weight percent.

There is no limitation to the lubricant for use in the present invention, provided that they are composed of solid inorganic compound used for lubricant.

Generally, boron nitride, mica, metal oxides, silicon nitride, sulfur compound, fluoride, talc, boron compound and phosphorus compound are preferably used therefor. However, other well known solid lubricants may be used therefor, which have conventionally been used as the mold releasing agent, such as molybdenum disulfide, graphite etc. These lubricants have powdery or granulated form, and only one kind of them or two or more kinds thereof are used in combined form.

Further, there is no special limitation to the organic polymer and the metal soap used for the present invention, provided that they have characteristics of giving the adhesive and bonding properties to the foregoing lubricants. Sodium, calcium, barium, lithium, potassium, magnesium or zinc salts of carboxylic acid is used for the metal soap; and polyethylene, polypropylene, epoxy resin, silicon resin, phenol resin, acrylate resin, alkyd resin or polystyrene are preferably used for the organic polymer. These organic polymers and metal soaps are mixed with the lubricant in a heated molten state. Accordingly, in the mold releasing agent according to the present invention, the lubricant is coated with the organic polymer or the metal soap. Incidentally, only one kind of the above-mentioned organic polymers and metal soaps is used, or two or more kinds of them are used in combined form.

FUNCTION

In the permanent mold casting powdery mold releasing agent according to the present invention, the lubricant has the powdery or granulated form so that the product is surely separated from the metal mold inside surface at least by a particle diameter of powder or granule of the lubricant at a part of the metal mold inside surface to which the mold releasing agent adheres. Consequently, the mold releasing agent adheres uniformly to the whole metal mold inside surface so that the seizure caused by the direct contact of the product with the metal mold inside surface can be avoided without fail. Further, since the mold releasing agent according to this invention is composed of the lubricant, the organic polymer and the metal soap and does not include water content, no defect due to remaining water arises in the product inside surface. Accordingly, the quality of product can be improved.

Moreover, in the mold releasing agent according to the present invention, the lubricant has the powdery or granulated form and does not include water content so that a tension working between the metal mold inside surface and the product is weak. Therefore, taking-out of the product from the metal mold becomes easy. Furthermore, the mold releasing agent can be removed easily from the metal mold inside surface and the product surface.

In addition, in the mold releasing agent of this invention, the lubricant has the powdery or granulated form so that the material is hard to react and scarcely generates gas even if it is subjected to heat during permanent mold casting.

Moreover, in the mold releasing agent of the present invention, the lubricant has a powdery or granulated form so that it can be used in the automated spraying device. Accordingly, the coating work can be fully performed and the dispersion of coated states on every time of the work can be avoided independently of skill of a coating worker, so that the quality of resulting products can be made always uniform.

EFFECT OF THE INVENTION

According to the present invention, in the permanent mold casting mold releasing agent composed of a mixture of the lubricant, the organic polymer and the metal soap, the lubricant has the powdery or granulated form. Therefore, the following advantages become obtainable.

(1) The occurrence of seizure and generation of inside defect of cast products of aluminium alloy and zinc alloy etc. obtained by the permanent mold casting method can be prevented positively so that their qualities can be improved.

(2) Good separation of the products from the dies can be accomplished, the permanent mold casting mold releasing agent can be removed from internal surfaces of dies and external surfaces of products, and further generation of gas during operation can be minimized. Consequently, the casting work by means of parmanent mold casting method can be carried out with better productivity.

(3) The permanent mold casting powdery mold releasing agent can be used in the automated spraying device. Accordingly, the quality of resulting product can always be made uniform independently of the skill of the coating worker by fully performing the coating work so that the dispersion of coating states on every time of the work can be avoided.

Especially, the quality of obtained castings can be improved by settling the content of the organic polymer and the metal soap in relation to the lubricant to the range of 0.1 through 45 weight percent.

Further, the above-mentioned effect can be enhanced still more when sodium, calcium, barium, lithium, potassium, magnessium or zinc salts of carboxylic acid is used for the metal soap, and polyethylene, polypropylene, epoxy resin, silicon resin, phenol resin, acrylate resin, alkyd resin or polystyrene is used for the organic polymer.

EMBODIMENTS

Embodiments of the present invention will be described below, but the invention is not limitted to these embodiments.

Following mold releasing agents (A) through (E) were obtained, casting tests based on the permanent mold casting method were carried out by using these mold releasing agents, and items listed in the TABLE were compared and examined.

Two kinds of mixtures: a mixture wherein the organic polymer or the metal soap is mixed with the lubricant in powdery or granulated form, and a mixture wherein the organic polymer or the metal soap is mixed with the lubricant in a heated molten state; were obtained for the embodiments (A) through (C) of the present invention.

The two kinds of mixtures were examined and obtained results were the same for the both mixtures. Incidentally, compounds as used for the mold releasing agents (A) through (E) are those available in the market.

(A) First embodiment comprising a mixture of 95 parts of boron nitride (average particle size: 1 through 5 microns) and 5 parts of calcium stearate (B) Second embodiment comprising a mixture of 20 parts of boron nitride, 75 parts of mica and 5 parts of polyethylene (C) Third embodiment comprising a mixture of 50 parts of boron nitride, 45 parts of silicon nitride, 3 parts of barium stearate and 2 parts of polypropylene (D) Boron nitride only (comparison embodiment 1)

(E) A prime coating mold lubricant with a major intention of heat insulating effect having an alumina and talc for its major base material, and a finish coating mold lubricant with a major intention of lubrication ability and releasing ability having an alumina, talc and graphite, which is coated on and regulated by the mold when used (comparison embodiment 2).

TABLE

| | (A) | (B) | (C) | (D) | (E) |
|---|---|---|---|---|---|
| Adhesion to metal mold | ∘ | ◎ | ◎ | x | ∘ |
| Casting surface | ◎ | ◎ | ◎ | — | ◎ |
| Releasing ability | ◎ | ◎ | ◎ | — | ∘ |
| Workability | ◎ | ◎ | ◎ | — | * |

x: Compretely non, —: Measurement impossible, *: Small, ∘: Intermediate; ◎: Large

What is claimed is:

1. In a method for permanent mold casting, comprising applying a mold releasing agent onto inside surfaces of a molding die in a permanent mold casting work, the improvement comprising applying a permanent mold casting powdery mold releasing agent consisting of a granulated or powdery mixture of:

(a) a lubricant selected from the group consisting of silicon nitride, molybdenum disulfide, graphite, mica, metal oxides, sulfur compound, fluoride, talc, boron compound and phosphorous compound;

(b) an organic polymer selected from the group consisting of polyethylene, polypropylene, polystyrene, epoxy resin, silicon resin, phenol resin, acrylate resin and alkyd resin; and (c) a metal soap selected from the group consisting of sodium, calcium, barium, lithium, potassium, magnesium and zinc salts of carboxylic acid;

wherein the lubricant is coated with the organic polymer or the metal soap.

2. The method according to claim 1, wherein the permanent mold casting powdery mold releasing agent contains 0.1 to 45 wt % of the organic polymer and the metal soap in relation to the lubricant.

3. The method according to claim 1, wherein the mold releasing agent is sprayed onto inside surfaces of the molding die.

4. The method according to claim 1, wherein the mold releasing agent is sprayed onto inside surfaces of the molding die by an automated spraying device.

5. The method according to claim 1, wherein the lubricant is boron nitride.

6. In a method for permanent mold casting, comprising applying a mold releasing agent onto inside surfaces of a molding die in a permanent mold casting work, the improvement comprising applying a permanent mold casting powdery mold releasing agent to the molding die, the mold releasing agent consisting of a granulated or powdery mixture of:

(a) a lubricant selected from the group consisting of boron nitride, silicon nitride, molybdenum disulfide, graphite, mica, metal oxides, fluoride and talc;

(b) an organic polymer selected from the group consisting of polyethylene, polypropylene, polystyrene and epoxy resin; and (c) a metal soap selected from the group consisting of sodium, calcium, barium, lithium, potassium, magnesium and zinc salts of carboxylic acid;

wherein the lubricant is coated with the organic polymer or the metal soap.

* * * * *

UNITED STATES PATENT AND TRADEMARK OFFICE

CERTIFICATE OF CORRECTION

PATENT NO.: 5,279,749
DATED : January 18, 1994
INVENTOR(S): Takashi HANANO

It is certified that error appears in the above-identified patent and that said Letters Patent is hereby corrected as shown below:

On the cover page, Item [62], after "694,609" insert --filed May 2, 1991, now abandoned".

Signed and Sealed this
Nineteenth Day of July, 1994

Bruce Lehman

*Attest:*

BRUCE LEHMAN

*Attesting Officer*

*Commissioner of Patents and Trademarks*